US006659881B2

(12) United States Patent
Lee

(10) Patent No.: US 6,659,881 B2
(45) Date of Patent: Dec. 9, 2003

(54) GOLF EXERCISER

(75) Inventor: Woo Hong Lee, Seoul (KR)

(73) Assignee: In Chul Kang, Kyunggido (KR)

( * ) Notice: Subject to any disclaimer, the term of this patent is extended or adjusted under 35 U.S.C. 154(b) by 0 days.

(21) Appl. No.: 10/301,835

(22) Filed: Nov. 22, 2002

(65) Prior Publication Data

US 2003/0171156 A1 Sep. 11, 2003

(30) Foreign Application Priority Data

Mar. 9, 2002 (KR) ..... 2002-12668
May 29, 2002 (KR) ..... 2002-29933

(51) Int. Cl.[7] ..... A63B 69/36
(52) U.S. Cl. ..... 473/279
(58) Field of Search ..... 473/135, 132, 473/134, 136, 278, 279

(56) References Cited

U.S. PATENT DOCUMENTS 4,279,420 A 7/1981 Bay et al.
4,613,133 A 9/1986 Selberg et al.
5,005,837 A 4/1991 Urra Martinez
5,340,111 A 8/1994 Froelich
5,683,306 A 11/1997 Tait et al.
5,820,478 A * 10/1998 Wood et al. ..... 473/279

* cited by examiner

*Primary Examiner*—Steven Wong
(74) *Attorney, Agent, or Firm*—Jacobson Holman PLLC

(57) ABSTRACT

The present invention relates to a golf training apparatus capable of realizing an inclined plane an inclination angle of which can be adjusted in an unpowered manner according to movement of the weight center of a user thereby allowing a golfer to have optimum golf training. The golf training apparatus can be easily installed indoor or outdoor where power is not supplied since it can adjust the angle of inclination without power. The upper plate can be rapidly inclined without any sway or noise. The golf training apparatus of the present invention also has advantages in that maintenance cost can be reduced in respect to power consumption, endurance is enhanced and maintenance is made easy. Moreover, since the golf training apparatus of the present invention may not use a power unit, the golf training apparatus has advantages in that the weight can be reduced and the cost can be saved compared to conventional powered golf training apparatuses, which may reduce economic burden of consumers.

10 Claims, 11 Drawing Sheets

GOLF EXERCISER

BACKGROUND OF THE PRESENT INVENTION

1. Field of the present invention

The present invention relates to a golf training apparatus, and more particularly, to a golf training apparatus capable of realizing an inclined plane an inclination angle of which can be adjusted in an unpowered manner thereby allowing a golfer to have optimum golf training.

2. Description of the Related Art

In general, golf training apparatuses are provided to allow golfers to have indoor or outdoor practice in limited places. Such golf training apparatuses are generally used by those who rarely go out to fields or need practice to improve their skill.

A golf training apparatus generally includes a flat upper plate and a rubber plate or an artificial turf plate layered on the upper plate. However, this type of golf training apparatus simply provides golf practice such as driving and putting on the ground. Such plate is restricted compared to fields having variously inclined planes.

Therefore, when a golfer goes out to fields after practicing driving or putting using a planar golf training apparatus, frequently the golfer adopts himself/herself to the fields later regarding the amount of practice, thereby failing to show his/her ability in golf. Under this circumstance, there is a noneconomic problem in that the golfer frequently goes out to fields consuming time and money by a large amount in order to get familiar to the fields.

In order to solve the above problems, golf training apparatuses are disclosed which are so constructed that a user can have practice in a limited place without moving to other place. In one of the most typical examples, a motor and a decelerator are provided in an intermediate portion of a lower plate having a leveling device and a lower plate roller. A coupling is disposed over the decelerator and connected to an angle-adjustment plate via a ball joint, with the plate functioning to adjust the angle of an inclined plane and having a joint-inserting hole. The angle-adjustment plate is contacted at an upper portion to upper plate rollers different from one another in length and at a lower portion to lower plate rollers so that a joint shaft is connected to an upper plate-fixing body under the upper plate which has a fitting projection and a reinforcing member. The upper plate has spring supports connected to the lower plate at both sides, and an external bellows housing is disposed.

However, the conventional golf training apparatus constructed as above has the following drawbacks: The golf training apparatus cannot be installed if there is no power source since it internally contains a motor and a mechanical device for transmitting power from the motor. Also, a drive unit occupies a large area thereby excessively increasing the height of the apparatus.

Also the golf training apparatus is not installed indoor if the ceiling is low, and treatment thereof is difficult since it is heavy.

Furthermore, since an angle-adjustment plate is rotated to determine the angle of inclination, a long time period is needed for movement to an opposed position. Mechanical drive creates sway and noise by a large amount during the adjustment of angle, and the range of the angle of inclination is limited.

SUMMARY OF THE PRESENT INVENTION

The present invention has been made to solve the foregoing problems and it is therefore an object of the present invention to provide a golf training apparatus capable of realizing an inclined plane in an unpowered manner, in which a user can have practice in a fixed limited place without moving to other place by adjusting an upper plate at a desired angle. The golf training apparatus can be readily installed indoor or outdoor without restriction in installation since it is driven in an unpowered manner. Further, the upper plate is adjusted at a desired inclination angle in a short time period without making sway or noise.

According to an aspect of the present invention to obtain the above objects, it is provided a golf training apparatus capable of realizing an inclined plane an inclination angle of which can be adjusted in an unpowered manner in a support plate on which a user stands, comprising: an upper plate for supporting the user standing thereon to have practice; a lower plate for fixing the apparatus to a bottom; a ball-feeding unit for automatically feeding balls; a support frame for supporting the ball-feeding unit in a detachably attached manner; an inclination adjustment valve for adjusting the inclined plane at a desired angle; a buffer unit for hydraulic flow rate for compensating both sway owing to differential pressure of hydraulic passages and bubbles occurring during the adjustment of the inclined plane and variation in volume of hydraulic oil owing to seasonal variation and temperature difference; a plurality of manipulation levers for allowing the user to manipulate the inclined plane on the upper plate; a hydraulic oil-piping unit for regulating and piping the hydraulic oil; a plurality of free hydraulic cylinders having a free vertical movement distance for allowing adjustment of the inclined plane; a shaft center-fixing unit for preventing release of a central shaft during the adjustment of the inclined plane; an upper plate-stabilizing unit for preventing rotation of the free hydraulic cylinders while allowing vertical movement thereof; and a leveling unit for leveling the golf training apparatus and maintaining the same in a leveled position when the user wants to have practice in the leveled position rather than on the inclined plane.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The following detailed description will disclose technical features of the present invention in reference to the accompanying drawings, but with illustrative purposes only.

Figure 1:
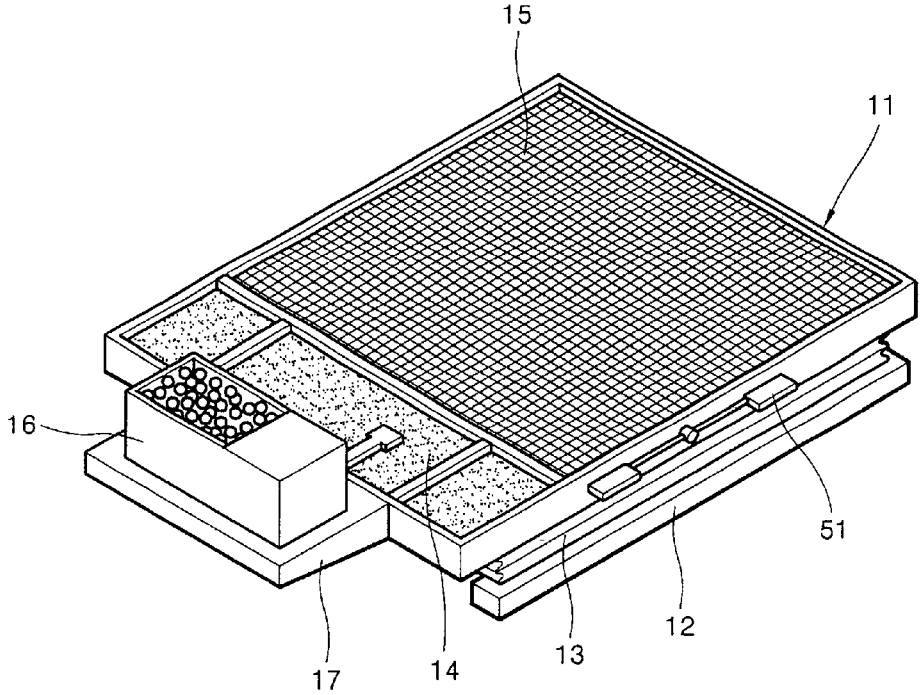
FIG. 1 is a perspective view of a golf training apparatus of the present invention.
Figure 2:
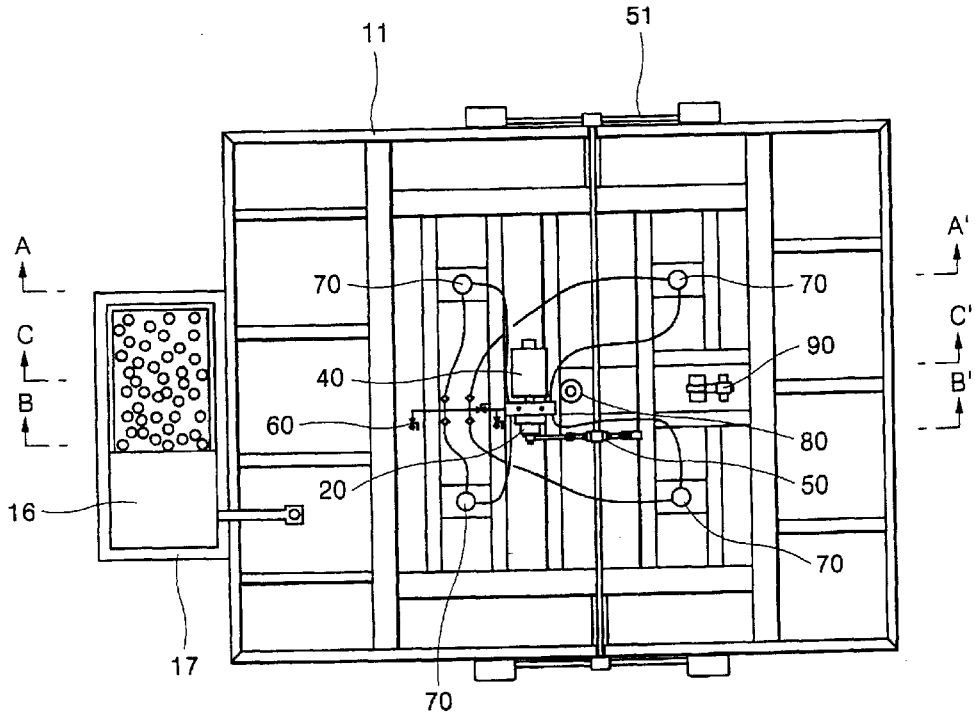
FIG. 2 is a schematic plan view illustrating an upper frame of the golf training apparatus of the present invention.
Figure 3:
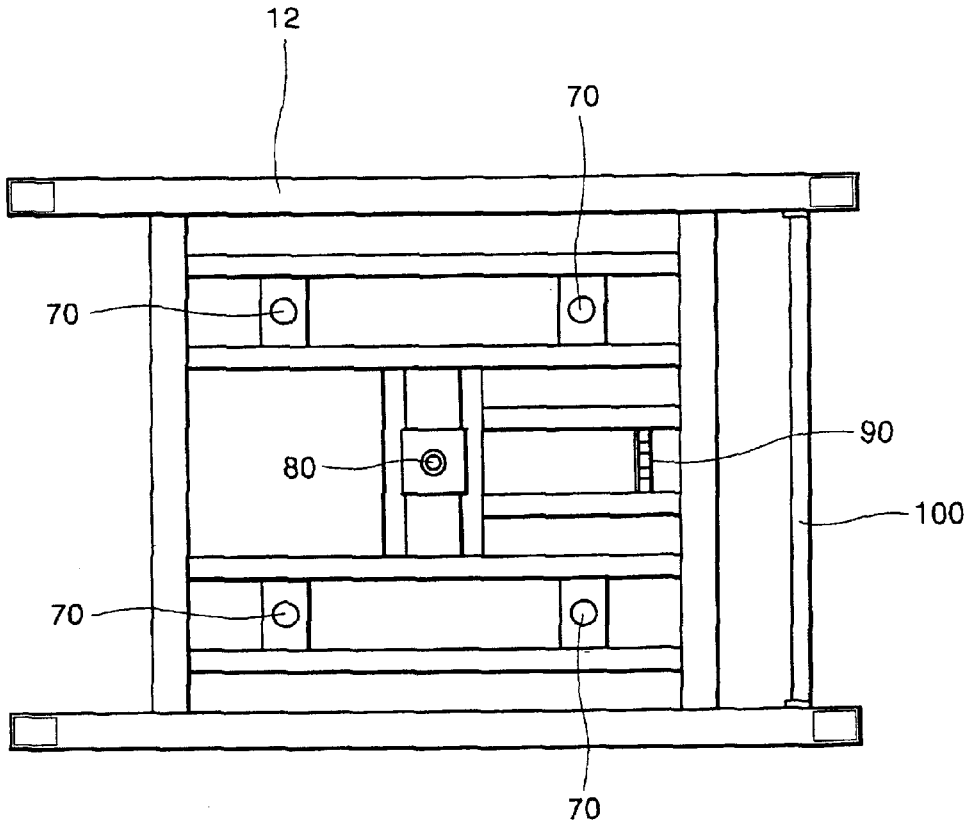
FIG. 3 is a schematic bottom view illustrating a lower frame of the golf training apparatus of the present invention.
Figure 4:
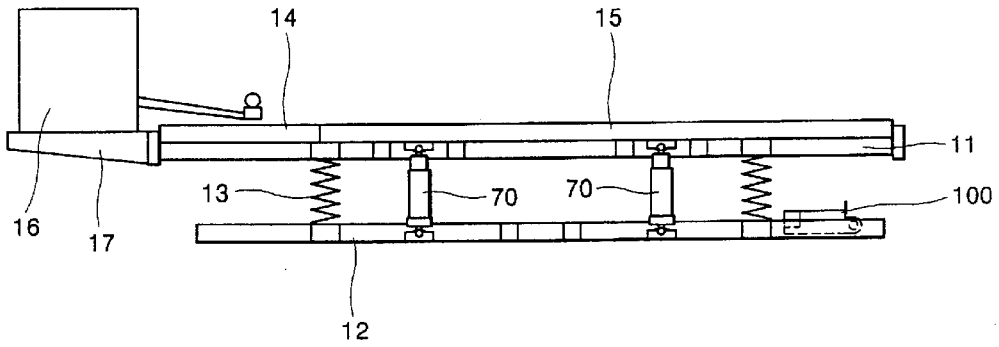
FIG. 4 is a cross-sectional view taken along a line A–A' of FIG. 2.
Figure 5:
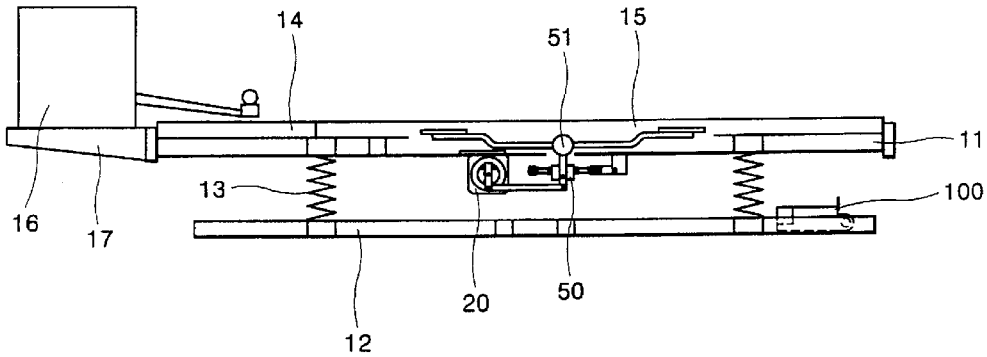
FIG. 5 is a cross-sectional view taken along a line B–B' of FIG. 2.
Figure 6:
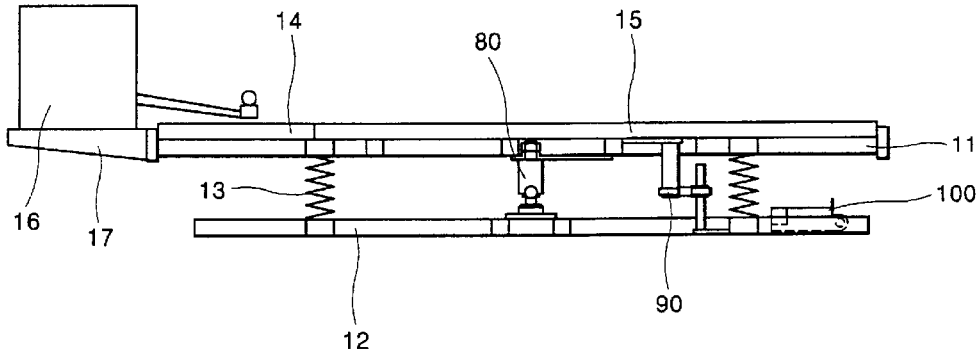
FIG. 6. is a cross-sectional view taken along a line C–C' of FIG. 2.
Figure 7:
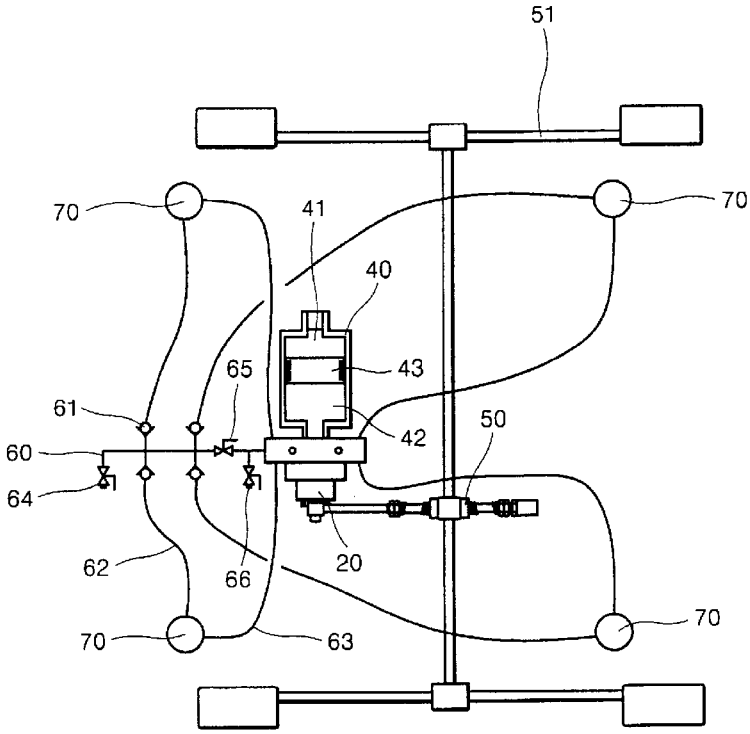
FIG. 7 is a detailed view of a buffer unit for hydraulic flow rate and a hydraulic oil-piping unit of the present invention.
Figure 8:
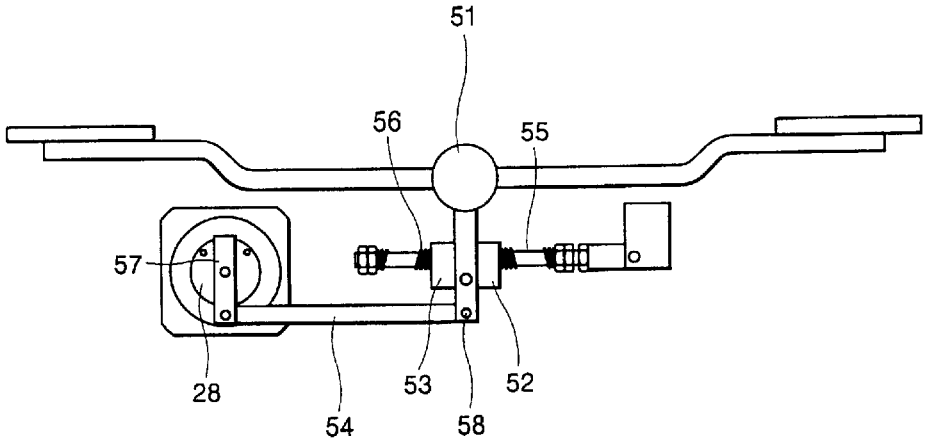
FIG. 8 is a detailed view of a manipulation lever of the present invention.
Figure 9A:
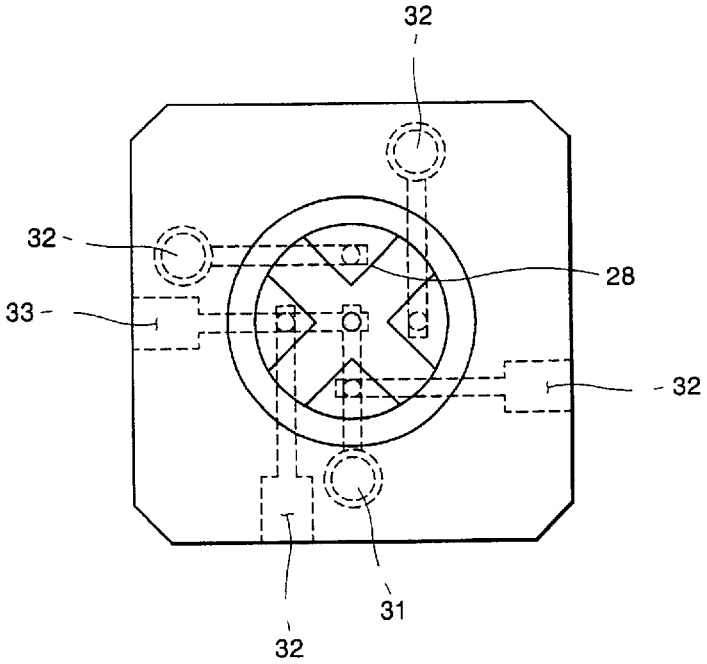
FIG. 9A is a plan sectional view of an inclination-adjustment valve of the present invention, with passages being closed.
Figure 9B:
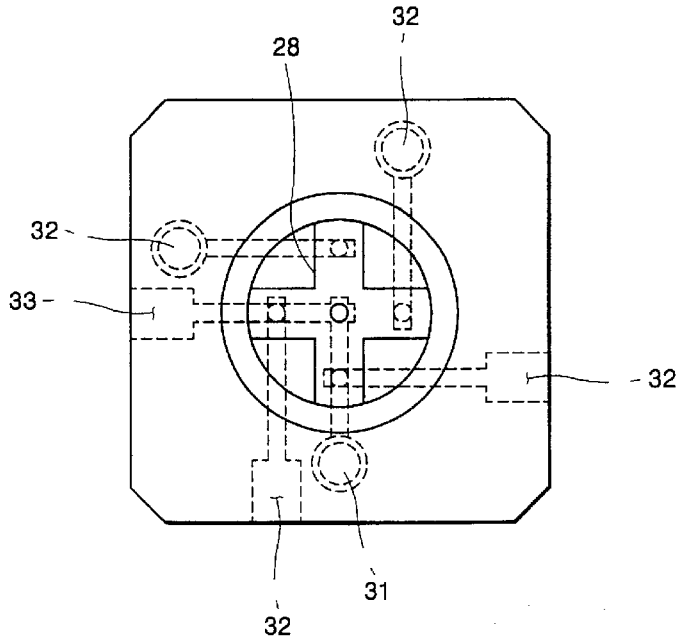
FIG. 9B is a plan sectional view of the inclination-adjustment valve of the present invention, with the passages being opened.
Figure 10A:
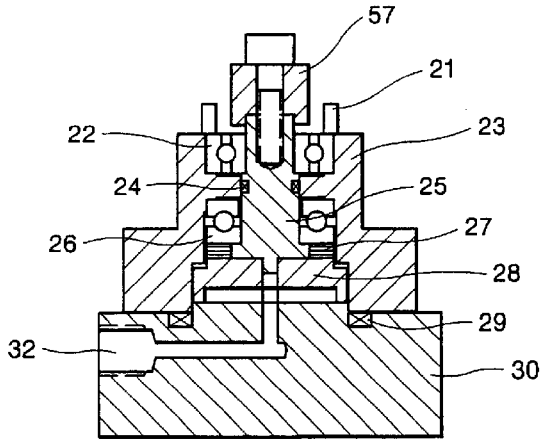
FIG. 10A is a side sectional view of the inclination-adjustment valve of the present invention.
Figure 10B:
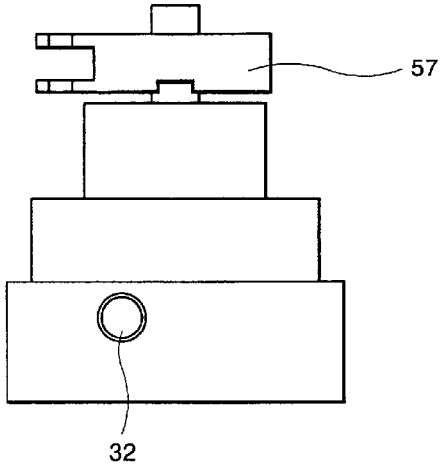
FIG. 10B is a side elevation view of the inclination-adjustment valve of the present invention.
Figure 11:
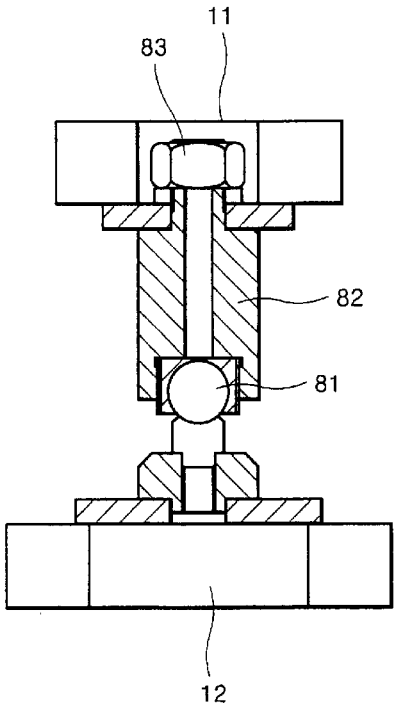
FIG. 11 is a detailed view of a shaft center-fixing unit of the present invention.
Figure 12:
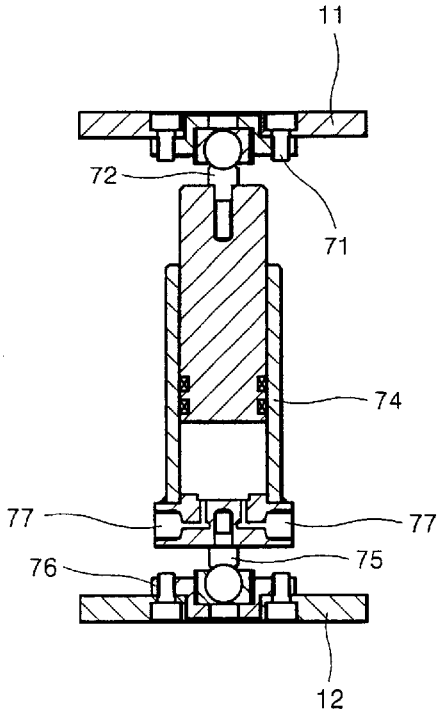
FIG. 12 is a detailed view of a free hydraulic cylinder of the present invention.
Figure 13:
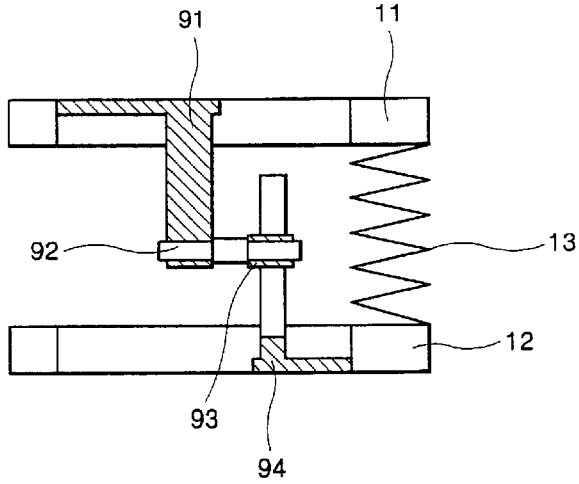
FIG. 13 is a sectional view of an upper plate-stabilizing unit of the present invention.
Figure 14:
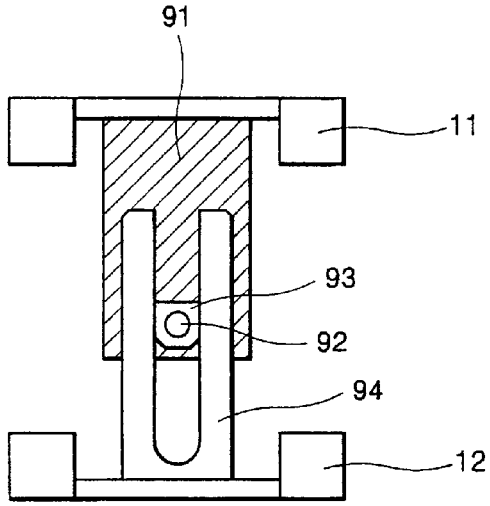
FIG. 14 is a side elevation view of the upper plate-stabilizing unit of the present invention.
Figure 15A:
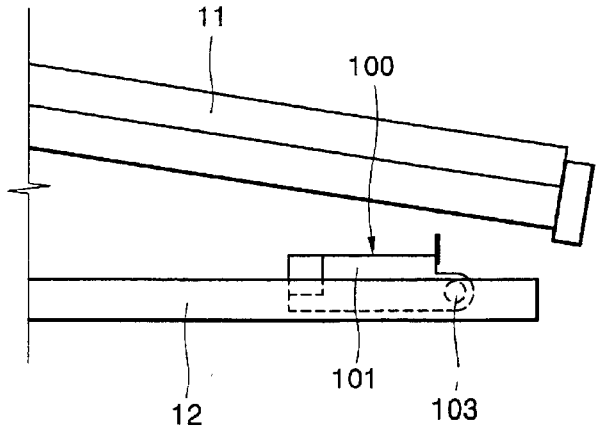
FIG. 15A is a side elevation view of a leveling unit of the present invention in a folded position.
Figure 15B:
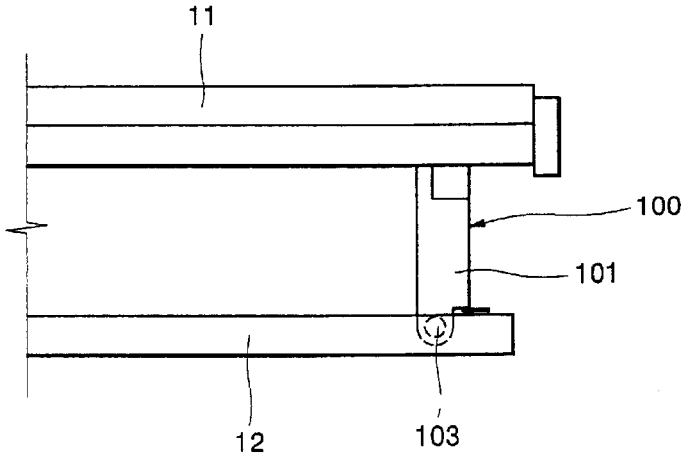
FIG. 15B is a side elevation view of the leveling unit of the present invention in an unfolded position.
Figure 16:
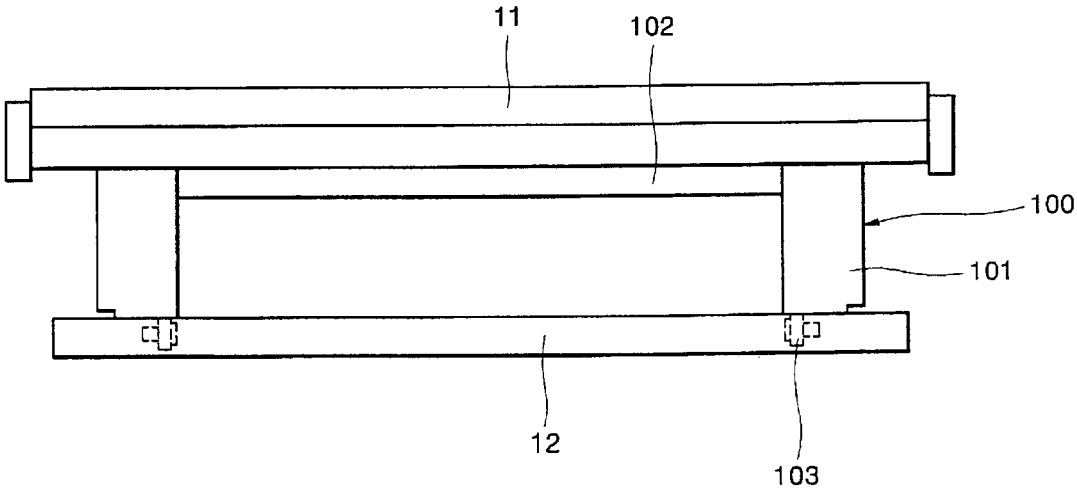
FIG. 16 is a front elevation view of the leveling unit of the present invention in the unfolded position.

FIG. 1 is a perspective view of a golf training apparatus of the present invention, FIG. 2 is a schematic plan view illustrating an upper frame of the golf training apparatus of the present invention, FIG. 3 is a schematic bottom view illustrating a lower frame of the golf training apparatus of the present invention, FIG. 4 is a cross-sectional view taken along a line A–A' of FIG. 2, FIG. 5 is a cross-sectional view taken along a line B–B' of FIG. 2, FIG. 6 is a cross-sectional view taken along a line C–C' of FIG. 2, FIG. 7 is a detailed view of a buffer unit for hydraulic flow rate and a hydraulic oil-piping unit of the present invention, FIG. 8 is a detailed view of a manipulation lever of the present invention, FIG. 9A is a plan sectional view of an inclination-adjustment valve of the present invention with passages being closed, FIG. 9B is a plan sectional view of the inclination-adjustment valve of the present invention with the passages being opened, FIG. 10A is a side sectional view of the inclination-adjustment valve of the present invention, FIG. 10B is a side elevation view of the inclination-adjustment valve of the present invention, FIG. 11 is a detailed view of a shaft center-fixing unit of the present invention, FIG. 12 is a detailed view of a free hydraulic cylinder of the present invention, FIG. 13 is a sectional view of an upper plate-stabilizing unit of the present invention, FIG. 14 is a side elevation view of the upper plate-stabilizing unit of the present invention, FIG. 15A is a side elevation view of a leveling unit of the present invention in a folded position, FIG. 15B is a side elevation view of the leveling unit of the present invention in an unfolded position, and FIG. 16 is a front elevation view of the leveling unit of the present invention in the unfolded position.

In the drawings, a flat rectangular upper plate of an upper fame designated with the reference number 11 stably supports a golfer or user while he/she has practice on an upper rubber plate overlying the upper plate 11. The upper plate 11 also serves to support other components which are mounted thereon to constitute the present invention. The components mounted on the upper plate 11 include an inclination-adjustment valve 20, an artificial turf 14, an upper rubber plate 15, a ball feeder support frame 17, a buffer unit 40 for hydraulic flow rate, a manipulation lever 50, a hydraulic oil-piping unit 60, free hydraulic cylinders 70, a shaft center-fixing unit 80, an upper plate-stabilizing unit 90 for preventing sway of the upper plate and so on.

Lower plates of a lower frame designated with the reference number 12 are flat rectangle-shaped, and define a frame structure of the golf training apparatus. The lower plates 12 fix the golf training apparatus on a bottom when the golf training apparatus is practically installed, and are configured to support other components which are mounted thereon to constitute the present invention. The components mounted on the lower plates 12 include a protective bellows 13, the free hydraulic cylinders 70, the shaft center-fixing unit 80, the upper plate-stabilizing unit 90 and so on.

The bellows designated with the reference number 13 is disposed between the upper plate 11 and the lower plates 12, and made of a material and into a structure for preventing penetration of any foreign materials or dust so that internal devices are not polluted.

The upper rubber plate designated with the reference number 15 is made of a material having a proper degree of flexibility and rigidity so that the user can have practice with his/her feet treading thereon.

The artificial turf designated with the reference number 14 provides a place in the form of an artificial turf mat where a golf ball is positioned when the user actually has practice, in which both ends of the mat provides spaces for aligning golf balls, and an indicator is attached at a portion of the mat to indicate the inclination angle of the upper plate and the present position on a plane of the mat.

A ball feeder designated with the reference number 16 is a device for automatically feeding balls used in golf training to a predetermined position. The ball feeder 16 may have an unpowered ball feeding unit or an electric ball-feeding unit.

The ball feeder support frame designated with the reference number 17 serves to mount the ball feeder 16 thereon, and is flat rectangle-shaped. The ball feeder support frame 17 is detachably attached to a side of the upper plate 11 adjacent to the artificial turf 14.

The inclination-adjustment valve designated with the reference number 20 opens/closes the free hydraulic cylinders 70. The inclination-adjustment valve 20 is connected to all of hydraulic oil passages in the four free hydraulic cylinders 70, and adjusted by adjustment levers 51.

The manipulation lever designated with the reference number 50 regulates the inclination-adjustment valve 20 to open or close the free hydraulic cylinders 70 so that the user can adjust the angle of inclination of the golf training apparatus of the present invention. The manipulation lever 50 is operated as follows:

As shown in FIGS. 8 to 9B, when the user presses down any of the adjustment levers 51 with a golf club or foot, two mutually connected rotating links 54 and 57 are actuated to rotate an passage opening/closing spool 28 of the inclination-adjustment valve 20. Then, as shown in FIGS. 9A and 9B, when a cross-shaped groove in the passage opening/closing spool 28 matches four holes in an adjustment valve body 30, the oil passages of the four free hydraulic cylinders 70 are simultaneously opened so that flow between hydraulic oil properly causes the upper plate 11 to make an inclined plane even though it is inclined at any angle.

Also, in order to fix the inclination angle which was tilted at an angle at his/her desire, the user releases the adjustment lever 51 so that the passage opening/closing spool 28 of the inclination-adjustment valve 20 returns to its original position to close flow between hydraulic oil thereby fixing the inclined plane.

FIGS. 10A and 10B show a detailed construction of the inclination-adjustment valve 20.

As shown in FIGS. 9A to 10B, the inclination-adjustment valve 20 of the present invention includes a stopper 21 for stopping the rotating link 57, a ball bearing 22 for softening operation of the passage opening/closing spool 28 and fixing the center of the spool 28, an inclination-adjustment valve housing 23 for furnishing and protecting valve parts, a first O-ring 24 for preventing leak of oil to the outside, an adjustment valve rotary shaft 25 for driving the passage opening/closing spool 28, a trust bearing 26 for supporting the pressure of a wave spring, the wave spring 27 for pressing the passage opening/closing spool 28 under a proper pressure so that hydraulic oil may not leak when the oil passages are closed, the passage opening/closing spool 28 for opening/closing the oil passages of hydraulic oil, a second O-ring 29 for preventing leak of oil to the outside, the adjustment valve body 30 configured to mount four hoses 63 for feeding/discharging hydraulic oil, the hydraulic flow rate buffer unit 40 and the hydraulic oil-piping unit 60 as well as fixable to the upper plate 11, a connector unit 31 for the hydraulic flow rate buffer unit and functioning to compensate sway owing to bubble creation in hydraulic oil as well as expansion and contraction of hydraulic oil owing to seasonal temperature variation, four hydraulic hose connector units 32 and a hydraulic oil inlet unit 33.

In the inclination-adjustment valve 20 constructed as above, the operation of the manipulation lever 50 for regulating passage opening/closing of the valve 20 will be described in detail as follows:

The golf training apparatus of the present invention has two adjustment levers 51 mounted respectively on both sides of the upper plate 11 and four manipulation plates, with two of them for each adjustment lever. When the user presses any of the manipulation plates at ends of the manipulation levers with the golf club or foot, standing on the upper plate opposed to the inclined plane to which he/she wants to move, the inclined plane can be adjusted with the weight of the user. In order to fix the adjusted inclined plane, the user releases the pressed manipulation plate so that a return spring 56 returns the manipulation plate to its original position fixing the inclined plane.

FIG. 8 illustrates a detailed construction of the above manipulation lever 50.

The manipulation lever 50 of the present invention includes the adjustment levers 51 connected to the manipulation plates which can be operated by the user, neutral positioning plates 52 and 53 capable of recovering their neutral positions to close the hydraulic passages when it is needed to fix the upper plate at any desired position of the inclined plane, the rotating links 54 and 57 for transmitting the motion of the adjustment levers 51, a neutral positioning shaft 55 capable of fixing the neutral positioning plates 52 and 53 and regulating a track of the inclination-adjustment valve 20, and the return spring 56 for automatically returning the adjustment levers 51 to their original position when the adjustment levers 51 are released from their operative positions.

According to the operation of the manipulation lever 50 and the inclination-adjustment valve 20, the inclined plane of the golf training apparatus of the present invention is actually regulated by the free hydraulic cylinders designated with the reference number 70. The following detailed description will discuss a construction and operation of each of the free hydraulic cylinders 70 in reference to FIG. 12.

As shown in FIG. 12, the free hydraulic cylinder 70 includes an upper ball joint-fixing plate 71 for fixation with the upper plate 11, an upper ball joint 72 capable of rotating along a track in an upper portion of the cylinder 70, a cylinder rod 73 for carrying out a piston movement during the upward and downward movement, a cylinder body 74 for supporting and guiding the cylinder rod 73, a lower ball joint 75 capable of rotating along a track in a lower portion of the cylinder 70, and a lower ball joint-fixing plate 76 for fixation with the lower plates 12.

The above free hydraulic cylinder 70 is in the form of a single-acting cylinder, and has two oil passages 77 in a lower portion, with one being connected to the inclination-adjustment valve 20 and the other one being connected to a check valve 61. The free hydraulic cylinder 70 is operated as follows:

The upper plate 11 is inclined owing to the difference between heights of the cylinder rods, in which the four cylinders have different heights according to the inclined plane.

Although the free hydraulic cylinder 70 of the present invention is fixed to the upper and lower plates, upper and lower ends of the cylinder can be rotated along endless tracks since they are connected via the ball joints 72 and 75. As a result, the free hydraulic cylinder 70 can rotate along an endless track according to the inclined plane about the shaft center-fixing unit 80. The body of the cylinder is also inclined depending upon the inclined plane, in which the cylinder has an angle of inclination which is varied depending upon the angle of inclination of the inclined plane of the upper plate. After forming the inclination angle owing to the difference of height to set the inclined plane, the endless free hydraulic cylinder is fixed in a position as the hydraulic circuit is closed in a fixing process.

FIG. 7 illustrates the buffer unit 40 for hydraulic flow rate and the hydraulic oil-piping unit 60. The buffer unit 40 for hydraulic flow rate will be described in detail in reference to FIG. 7 as follows:

As shown in FIG. 7, the buffer unit 40 for hydraulic flow rate includes a gas compression chamber 41 capable of compressing and filling inert gas, a hydraulic oil storage chamber 42 capable of storing and feeding hydraulic oil, and a diaphragm spool 43 for forming a diaphragm in response to a differential pressure owing to the volume change of hydraulic oil. The operation of the buffer unit 40 will be described as follows:

As the free hydraulic cylinders 70 of the present invention continue upward and downward movement at desired heights, flow rate in a cylinder may not correctly correspond to that in another cylinder so that bubbles in hydraulic oil may gather in one of the four free hydraulic cylinders, potentially swaying the upper plate. That is, hydraulic oil can malfunction if seasonal temperature variation and temperature difference between day and night are continued.

The buffer unit 40 for hydraulic flow rate serves to solve the above problem, in which inert gas such as nitrogen gas and carbonic acid gas is filled into the gas compression chamber 41 under a pressure lower than the filling pressure of hydraulic oil so that hydraulic oil in the storage chamber 42 feeds the free hydraulic cylinders 70 when the oil passage of the inclination-adjustment valve 20 is closed. This overcomes the problem of bubble creation. Also the diaphragm spool 43 moves due to the differential pressure to overcome contraction and expansion of hydraulic oil owing to the temperature difference.

The training apparatus of the present invention is so designed that hydraulic oil can smoothly move since a slight amount of differential pressure exists between the inside of the training apparatus and hydraulic oil of the free hydraulic cylinders 70.

Also in the present invention, the hydraulic oil passages are closed simultaneously with the inclination-adjustment valve 20.

Hereinafter the hydraulic oil-piping unit 60 will be described in detail in reference to FIG. 7 as follows:

As shown in FIG. 7, it can be seen that the hydraulic oil-piping unit 60 is a combination including: four check valves 61 for preventing backflow of hydraulic oil in opening the oil passages of the four free hydraulic cylinders 70 and a piping system, the inclination-adjustment valve 20, the manipulation lever 50, the buffer unit 40 for hydraulic flow rate, a hydraulic oil feed valve 64, a passage opening/closing valve 65, a vent valve 66 and so on.

Describing this in more detail, the hydraulic oil-piping unit 60 includes the check valves 61 for preventing backflow of hydraulic oil toward the inclination-adjustment valve 20 when the passages of the free hydraulic cylinders 70 are opened as well as compensating hydraulic oil from the hydraulic flow rate buffer unit 40 toward the hydraulic cylinders 70 when the passages of the hydraulic cylinders 70 are closed to perform a buffering action, buffer hoses 62 for hydraulic flow rate used in buffering flow rate, feed and discharge hoses 63 for hydraulic oil used in opening the passages of the free hydraulic cylinders 70, the hydraulic oil feed valve 64 for filling hydraulic oil, the passage opening/closing valve 65, and the vent valve 66 for exhausting air out of a hydraulic circuit. The passage opening/closing valve 65 is closed when hydraulic oil filled into the hydraulic circuit. Then, hydraulic oil is discharged into the free hydraulic cylinders 70, the inclination-adjustment valve 20, the buffer unit 40 for hydraulic flow rate and the vent valve 66, and used in filling hydraulic oil. The passage opening/closing valve 65 is opened during the operation of the golf training apparatus.

Hereinafter the shaft center-fixing unit 80 will be described in detail in reference to FIG. 11.

As shown in FIG. 11, the shaft center-fixing unit 80 includes a fixing nut 83 for fixation with the upper plate 11, a free fixing shaft 82 capable of freely varying its angle according to the variation in angle of the upper plate, and a ball joint 81 for performing central rotation according to the variation in angle of the upper plate.

The above shaft center-fixing unit 80 is fixed to the upper plate 11 via a screw structure and integrally incorporated with the lower plate 12 via the ball joint attached thereto so that the upper plate 11 can be inclined at any angle. This functions to prevent that a central portion of the upper plate slips from the shaft center-fixing unit 80 even though the angle of inclination is changed.

Hereinafter the upper plate-stabilizing unit 90 will be described in detail in reference to FIGS. 13 and 14, in which FIG. 13 is a sectional view of the upper plate-stabilizing unit 90, and FIG. 14 is a side elevation view of the upper plate-stabilizing unit 90.

As shown in FIGS. 13 and 14, the upper plate-stabilizing unit 90 includes: an upper fixing plate 91 for fixation with the upper plate 11; a guide shaft 92 for fixing a guide bushing 93 and preventing rotation of the upper and lower plates while allowing vertical motion thereof; the guide bushing 93 capable of moving along a guide plane and rotating at an angle according to the inclined plane of the upper plate; and a lower fixing plate 94 fixed to the lower plate 12 and defining the guide plane.

The above upper plate-stabilizing unit 90 is so constructed that the centrally-disposed shaft center-fixing unit 80 adjusts the golf training apparatus of the present invention to have a plane inclined in a desired direction such as a forward, backward or lateral direction. Since support points for supporting both ends of the four hydraulic cylinders 70 are hinge structured in the form of a ball joint and thus the upper plate 11 substantially performs rotation when seen from the plane, the upper plate-stabilizing unit 90 serves to compensate and prevent rotation of the upper plate The upper plate-stabilizing unit 90 is individually fixed to the upper plate 11 and the lower plate 12 and supports vertical motion while disabling rotational circular motion so that the upper plate 11 may not rotate even though rotated at any angle, thereby affording stability to the user while he/she uses the golf training apparatus of the present invention.

Hereinafter a leveling unit 100 will be described in detail in reference to FIGS. 15A to 16, in which FIG. 15A is a side elevation view of the leveling unit of the present invention in a folded position, FIG. 15B is a side elevation view of the leveling unit of the present invention in an unfolded position, and FIG. 16 is a front elevation view of the leveling unit of the present invention in the unfolded position.

As shown in FIGS. 15A to 16, the leveling unit 100 includes two supports 101 for supporting the weight of the upper plate 11 and the user standing on the upper plate 11, a connector bar 102 for integrally connecting the two supports 101 and a hinge 103 for fixing the unit to the lower plate 12 in such a fashion that the unit can be folded/unfolded to/from the lower plate 12.

The leveling unit 100 of the present invention having the above construction is mounted on a portion of the lower plate 12, and serves to level the golf training apparatus and maintain the same in a leveled position when the user wants to have golf practice on a leveled plane rather than on the inclined plane.

When the user switches the golf training apparatus of the present invention from the inclined position to the leveled position, the leveling unit 100 ensures the balance of the golf training apparatus. Also the leveling unit 100 prevents sway of the golf training apparatus as the user moves the center of weight during golf practice in the leveled position.

When the user wants to have golf practice on the inclined plane after having practice in the leveled position, as shown in FIG. 15*a*, the user may fold the leveling unit 100 via the hinge 103 and incline the upper plate using the manipulation lever 50.

According to the "unpowered inclined-plane golf training apparatus" of the present invention as set forth above, the user can advantageously have practice in a limited place without moving to other place by adjusting the angle of inclination of the upper plate.

Further, the golf training apparatus can be easily installed indoor or outdoor where power is not supplied since it can adjust the angle of inclination without power.

The upper plate can be rapidly inclined without any sway or noise.

The golf training apparatus of the present invention also has advantages in that maintenance cost can be reduced in respect to power consumption, endurance is enhanced and maintenance is made easy.

Moreover, since the golf training apparatus of the present invention may not use a power unit, the golf training apparatus has advantages in that the weight can be reduced and the cost can be saved compared to conventional powered golf training apparatuses. Also this may reduce economic burden of consumers.

What is claimed is:

1. A golf training apparatus capable of realizing an inclined plane an inclination angle of which can be adjusted in an unpowered manner in a support plate on which a user stands, comprising:

an upper plate for supporting the user standing thereon to have practice;

a lower plate for fixing the apparatus to a bottom;

a ball-feeding unit for automatically feeding balls;

a support frame for supporting the ball-feeding unit in a detachably attached manner;

an inclination adjustment valve for adjusting the inclined plane at a desired angle;

a buffer unit for hydraulic flow rate for compensating both sway owing to differential pressure of hydraulic passages and bubbles occurring during the adjustment of the inclined plane and variation in volume of hydraulic oil owing to seasonal variation and temperature difference;

a plurality of manipulation levers for allowing the user to manipulate the inclined plane on the upper plate;

a hydraulic oil-piping unit for regulating and piping the hydraulic oil;

a plurality of free hydraulic cylinders having a free vertical movement distance for allowing adjustment of the inclined plane;

a shaft center-fixing unit for preventing release of a central shaft during the adjustment of the inclined plane;

an upper plate-stabilizing unit for preventing rotation of the free hydraulic cylinders while allowing vertical movement thereof; and a leveling unit for leveling the golf training apparatus and maintaining the same in a leveled position when the user wants to have practice in the leveled position rather than on the inclined plane.

2. The golf training apparatus in accordance with claim 1, wherein the inclined plane is adjusted by the movement of weight and balance of the user using hydraulic pressure in an unpowered manner.

3. The golf training apparatus in accordance with claim 1, wherein the inclination-adjustment valve includes:

a stopper for stopping a rotating link;

a ball bearing for softening the operation of a passage opening/closing spool and fixing the center thereof;

an inclination-adjustment valve housing for furnishing and protecting valve parts;

a first O-ring for preventing leak of oil to the outside;

an adjustment valve rotary shaft for driving the passage opening/closing spool;

a trust bearing for supporting the pressure of a wave spring;

a wave spring for pressing the passage opening/closing spool under a proper pressure to prevent leak of hydraulic oil when the passages are closed;

the passage opening/closing spool for defining opened/closed passages of hydraulic oil;

a second O-ring for preventing leak of oil to the outside;

an adjustment valve body configured to mount four hoses for feeding/discharging hydraulic oil, the hydraulic flow rate buffer unit and the hydraulic oil-piping unit as well as fixable to the upper plate a first connector unit for the hydraulic flow rate buffer unit for compensating sway owing to bubble creation in hydraulic oil and expansion and contraction of hydraulic oil owing to seasonal temperature variation;

a second connector unit for connecting the four hydraulic hoses; and a hydraulic oil inlet unit.

4. The golf training apparatus in accordance with claim 1, wherein the buffering unit for hydraulic flow rate includes:

a gas compression chamber for compressing and filling inert gas;

a hydraulic oil storage chamber for storing and feeding hydraulic oil; and a diaphragm spool for defining a diaphragm according to differential pressure owing to volume variation in hydraulic oil to isolate each of the chambers.

5. The golf training apparatus in accordance with claim 1, wherein each of the manipulation levers for adjusting the adjustment valve includes:

an adjustment lever connected to a manipulation plate operated by the user;

neutral positioning plates for recovering their neutral positions to close the hydraulic passages when it is needed to fix the upper plate at any desired position of the inclined plane;

rotating links for transmitting the operation of the adjustment lever;

a neutral positioning shaft for fixing the neutral positioning plates and adjusting a track of the inclination-adjustment valve; and a return spring for automatically recovering the adjustment lever to its original position when the adjustment lever is released from an operational position.

6. The golf training apparatus in accordance with claim 1, wherein the hydraulic oil-piping unit includes:

a check valve for preventing backflow of hydraulic oil toward the inclination-adjustment valve when the passages of the free hydraulic cylinders are opened and for feeding hydraulic oil from the hydraulic flow rate buffer unit toward hydraulic cylinders when the passages of the hydraulic cylinders are closed to carry out a buffering function;

a hydraulic flow rate buffer hose used in buffering flow rate;

a hose for feeding and discharging hydraulic oil used in opening the passages of the free hydraulic cylinders;

a hydraulic oil feed valve for filling hydraulic oil;

a passage opening/closing valve closed when hydraulic oil is filled into a hydraulic circuit so that hydraulic oil flows via the check valve to the free hydraulic cylinders, the inclination-adjustment valve, the hydraulic flow rate buffer unit and the vent valve to fill hydraulic oil, and opened during the operation of the golf training apparatus; and the vent valve for discharging air out of the hydraulic circuit.

7. The golf training apparatus in accordance with claim 1, wherein each of the free hydraulic cylinders includes:

an upper ball joint-fixing plate for fixation with the upper plate;

an upper ball joint for rotating along a desired track in an upper portion of the cylinder;

a cylinder rod for performing a piston movement during the vertical motion;

a cylinder body for supporting and guiding the cylinder rod;

a lower ball joint for rotating along a desired track in a lower portion of the cylinder;

a lower ball joint-fixing plate for fixation with the lower plate; and two oil passages connected respectively to the inclination-adjustment valve and the check valve.

8. The golf training apparatus in accordance with claim 1, wherein the shaft center-fixing unit includes:

a fixing nut for fixation with the upper plate;

a free fixing shaft for freely changing its angle according to variation in angle of the upper plate; and a ball joint for performing central rotation according to variation in angle of the upper plate in a fixed position of the ball joint.

9. The golf training apparatus in accordance with claim 1, wherein the upper plate-stabilizing unit includes:

an upper plate-fixing plate for fixation with the upper plate;

a guide shaft for fixing a guide bushing, and preventing the rotational motion of the upper and lower plates while allowing the vertical motion thereof;

a guide bushing moving along a guide plane during the vertical motion and rotating at a desired angle according to the inclination angle of the upper plate; and a lower fixing plate fixed to the lower plate and forming the guide plane.

10. The golf training apparatus in accordance with claim 1, wherein the leveling unit includes:

two supports for supporting the weight of the upper plate and the user applied onto the upper plate;

a connector bar for integrally connecting the two supports; and a hinge for fixing the leveling unit to the lower plate while allowing the leveling unit to be folded or unfolded.

* * * * *